US010208527B1

(12) United States Patent
Aery

(10) Patent No.: US 10,208,527 B1
(45) Date of Patent: Feb. 19, 2019

(54) DOOR SEAL KIT

(71) Applicant: Ryan Aery, Riverhead, NY (US)

(72) Inventor: Ryan Aery, Riverhead, NY (US)

( * ) Notice: Subject to any disclaimer, the term of this patent is extended or adjusted under 35 U.S.C. 154(b) by 0 days.

(21) Appl. No.: 15/944,370

(22) Filed: Apr. 3, 2018

(51) Int. Cl.
*E06B 3/30* (2006.01)

(52) U.S. Cl.
CPC ..... *E06B 3/301* (2013.01)

(58) Field of Classification Search
CPC ..... E06B 3/301
See application file for complete search history.

(56) References Cited

U.S. PATENT DOCUMENTS 1,823,947 A * 9/1931 MacAulay ..... E06B 7/14 52/202
2,221,005 A * 11/1940 Reese ..... E06B 3/28 49/61
2,576,348 A * 11/1951 Kinghorn ..... E06B 3/28 52/202
2,578,470 A * 12/1951 Gorell ..... E06B 3/2605 49/67
2,771,021 A 10/1953 Buckley
D204,454 S 4/1966 Selkirk
3,251,399 A * 5/1966 Grossman ..... E06B 3/285 160/180
4,271,566 A * 6/1981 Perina ..... A44B 18/00 160/180
4,409,758 A * 10/1983 Dickerson ..... E06B 3/28 160/231.2
4,494,342 A * 1/1985 Decker ..... E06B 3/5418 52/203
4,581,865 A * 4/1986 Miller ..... E06B 3/28 52/202
4,733,510 A * 3/1988 Werner ..... E06B 3/28 428/34
4,874,028 A 10/1989 Lynch
5,481,833 A * 1/1996 Williams ..... E06B 9/24 160/180
5,918,430 A * 7/1999 Rowland ..... E06B 3/28 244/129.3
6,308,474 B1 * 10/2001 Wilson ..... E04G 21/30 150/154
7,097,891 B2 8/2006 Fenelon
8,528,279 B1 * 9/2013 Greene, Jr. ..... E06B 9/01 49/55

(Continued)

FOREIGN PATENT DOCUMENTS

DE 10128731 A1 * 2/2002 ..... G05G 9/047
DE 102012005458 A1 * 9/2013 ..... E04B 1/7641
GB 2146377 A * 4/1985 ..... E06B 3/28

*Primary Examiner* — Jeanette E Chapman
(74) *Attorney, Agent, or Firm* — Kyle A. Fletcher, Esq.

(57) ABSTRACT

The door seal kit is configured for use with a door. The door seal kit is a gas impermeable structure. The door seal kit forms a gas impermeable seal around the door. The gas impermeable seal prevents the exchange of gas from the atmosphere on the side of the door seal kit that is proximal to the door to the side of the door seal kit that is distal from the door. The door seal kit is used to contain gases, and their associated smells, within the room the door accesses. The door seal kit comprises a jamb frame and a sealing structure. The jamb frame attaches the sealing structure to the door jamb. The sealing structure forms the gas impermeable barrier around the door.

16 Claims, 5 Drawing Sheets

(56) References Cited

U.S. PATENT DOCUMENTS

| | | | | |
|---|---|---|---|---|
| 2002/0184841 | A1* | 12/2002 | Diamond | E06B 9/02 52/203 |
| 2008/0313980 | A1* | 12/2008 | Holland | E06B 9/02 52/202 |
| 2009/0008039 | A1 | 1/2009 | Lambridis | |
| 2009/0031645 | A1* | 2/2009 | Smith | E04F 13/0803 52/127.6 |
| 2011/0308747 | A1 | 12/2011 | Starzomski | |
| 2014/0202721 | A1 | 7/2014 | Shaw | |
| 2014/0245673 | A1* | 9/2014 | Millman | E06B 5/025 52/202 |
| 2014/0311097 | A1 | 10/2014 | Etienne | |
| 2015/0107169 | A1* | 4/2015 | Scott | E06B 9/02 52/202 |
| 2015/0376938 | A1* | 12/2015 | Pardue | E06B 3/28 52/202 |

* cited by examiner

DOOR SEAL KIT

TITLE OF INVENTION

Door Seal Kit

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of building including fixed closures and doors, more specifically, a sealing arrangement in connection with a door.

SUMMARY OF INVENTION

The door seal kit is configured for use with a door. The door is further defined with a door jamb and a plurality of hinges. The door seal kit is a gas impermeable structure. The door seal kit forms a gas impermeable seal around the door. The gas impermeable seal prevents the exchange of gas from the atmosphere on the side of the door seal kit that is proximal to the door to the side of the door seal kit that is distal from the door. The door seal kit is used to contain gases, and their associated smells, within the room the door accesses. The door seal kit comprises a jamb frame and a sealing structure. The jamb frame attaches the sealing structure to the door jamb. The sealing structure forms the gas impermeable barrier around the door. The plurality of door hinges attach the door to the door jamb such that the door opens away from the door seal kit during normal use of the door seal kit.

These together with additional objects, features and advantages of the door seal kit will be readily apparent to those of ordinary skill in the art upon reading the following detailed description of the presently preferred, but nonetheless illustrative, embodiments when taken in conjunction with the accompanying drawings.

In this respect, before explaining the current embodiments of the door seal kit in detail, it is to be understood that the door seal kit is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the door seal kit.

It is therefore important that the claims be regarded as including such equivalent construction insofar as they do not depart from the spirit and scope of the door seal kit. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
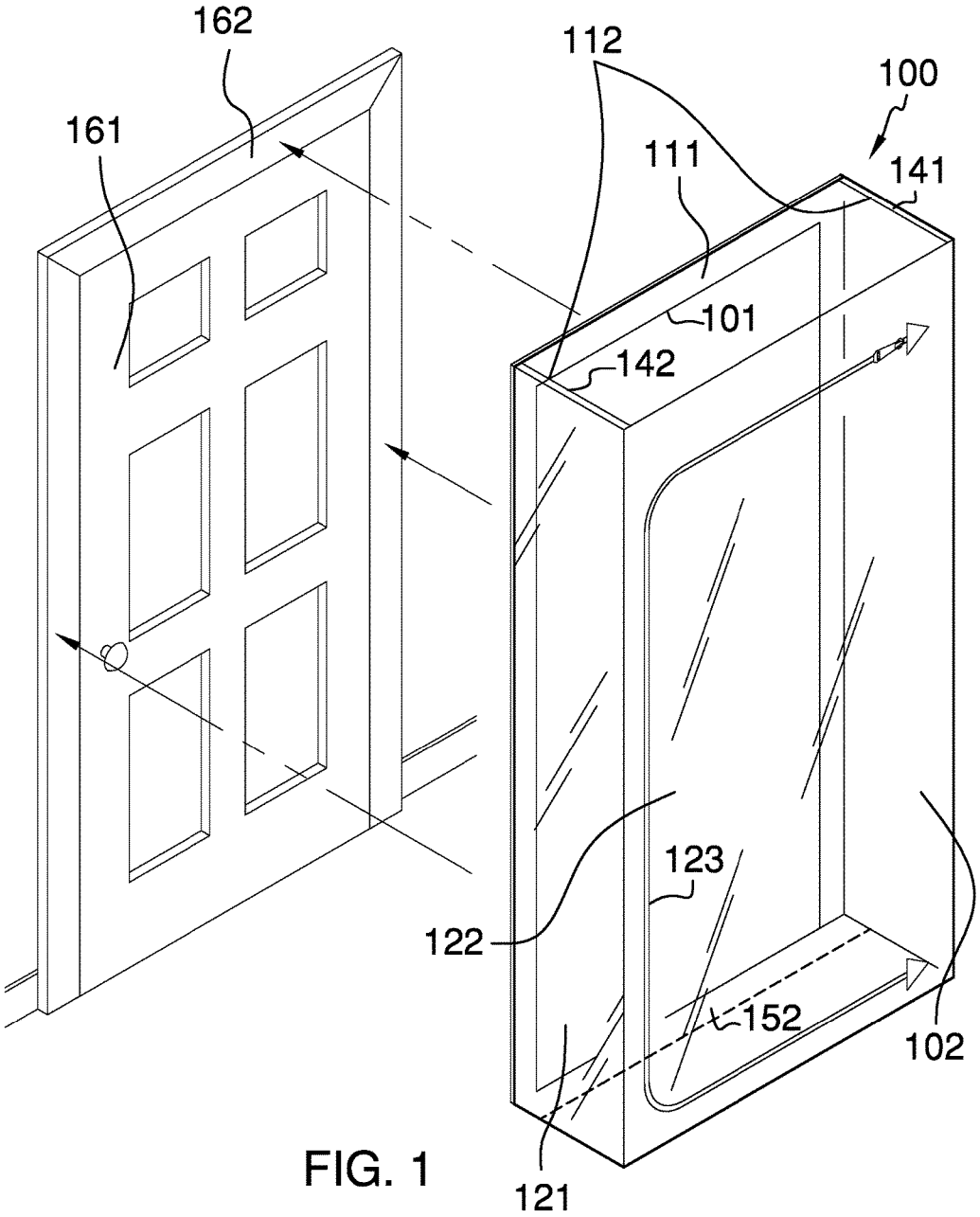
FIG. 1 is a perspective view of an embodiment of the disclosure.
Figure 2:
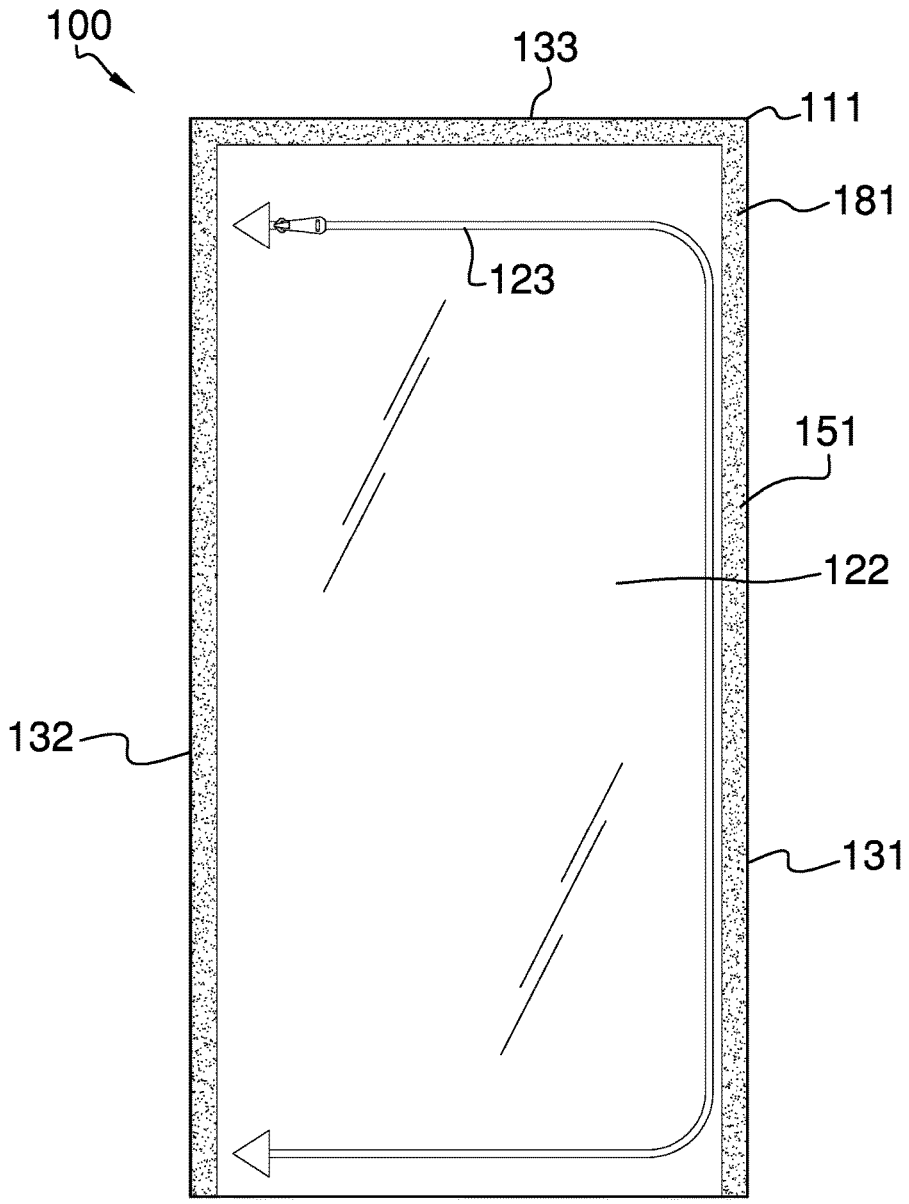
FIG. 2 is a rear view of an embodiment of the disclosure.
Figure 3:
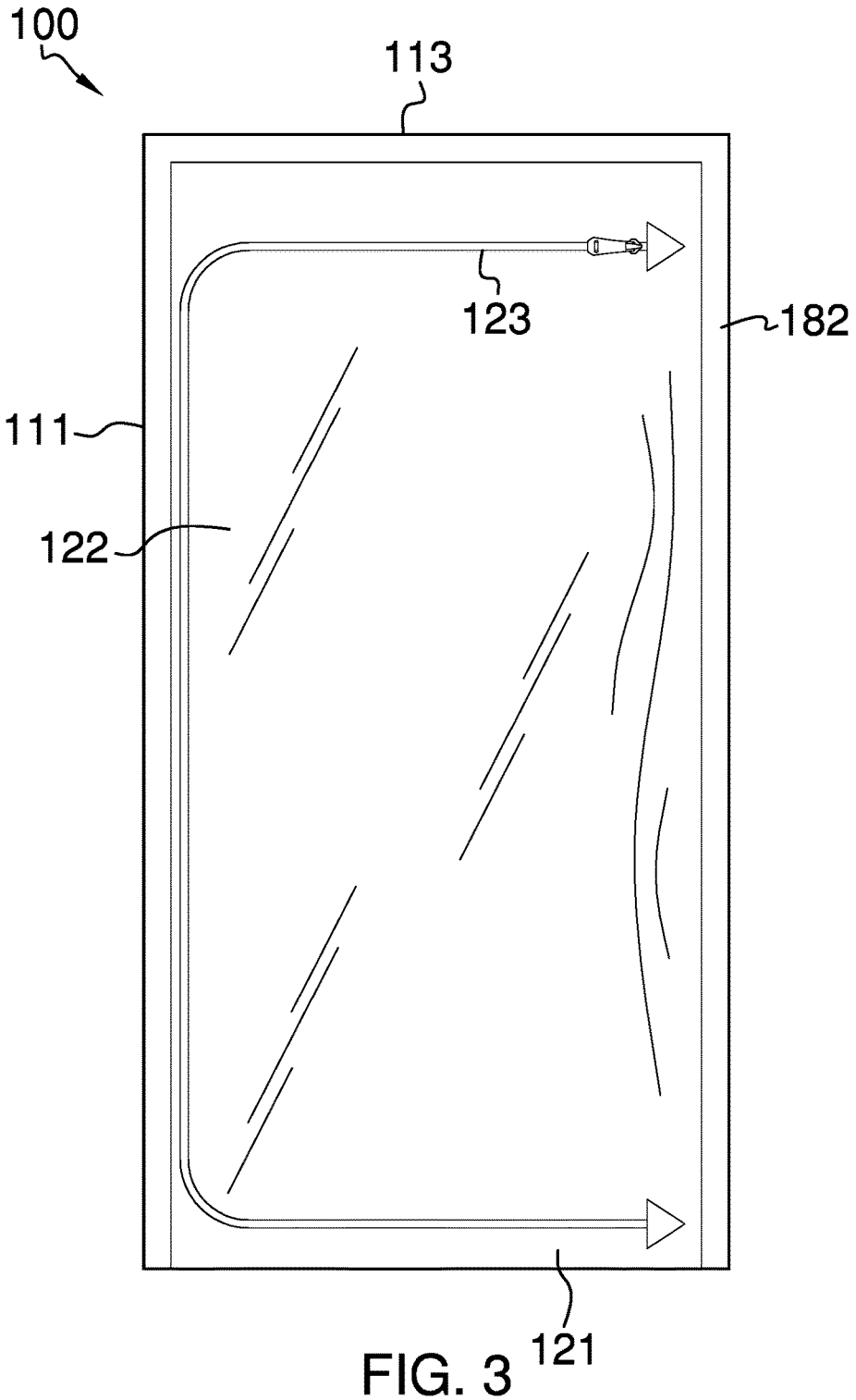
FIG. 3 is a front view of an embodiment of the disclosure.
Figure 4:
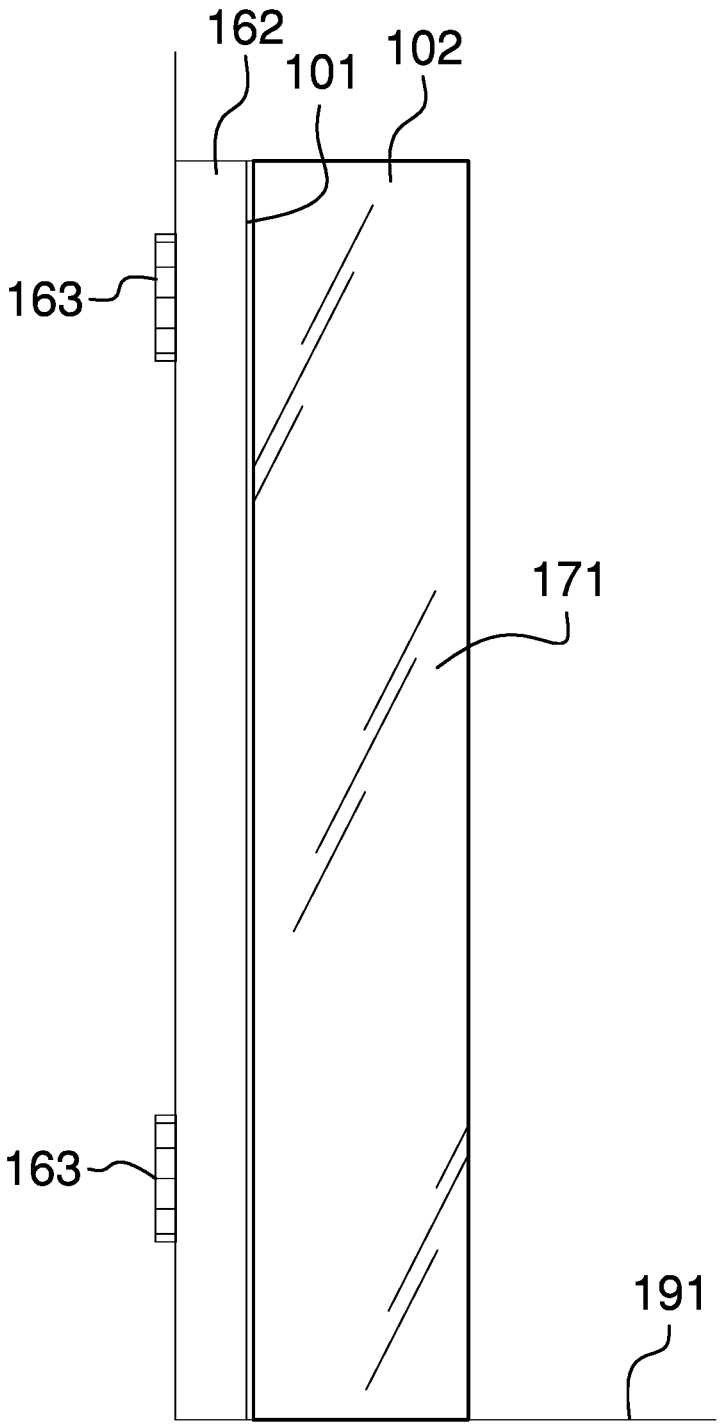
FIG. 4 is a side view of an embodiment of the disclosure.
Figure 5:
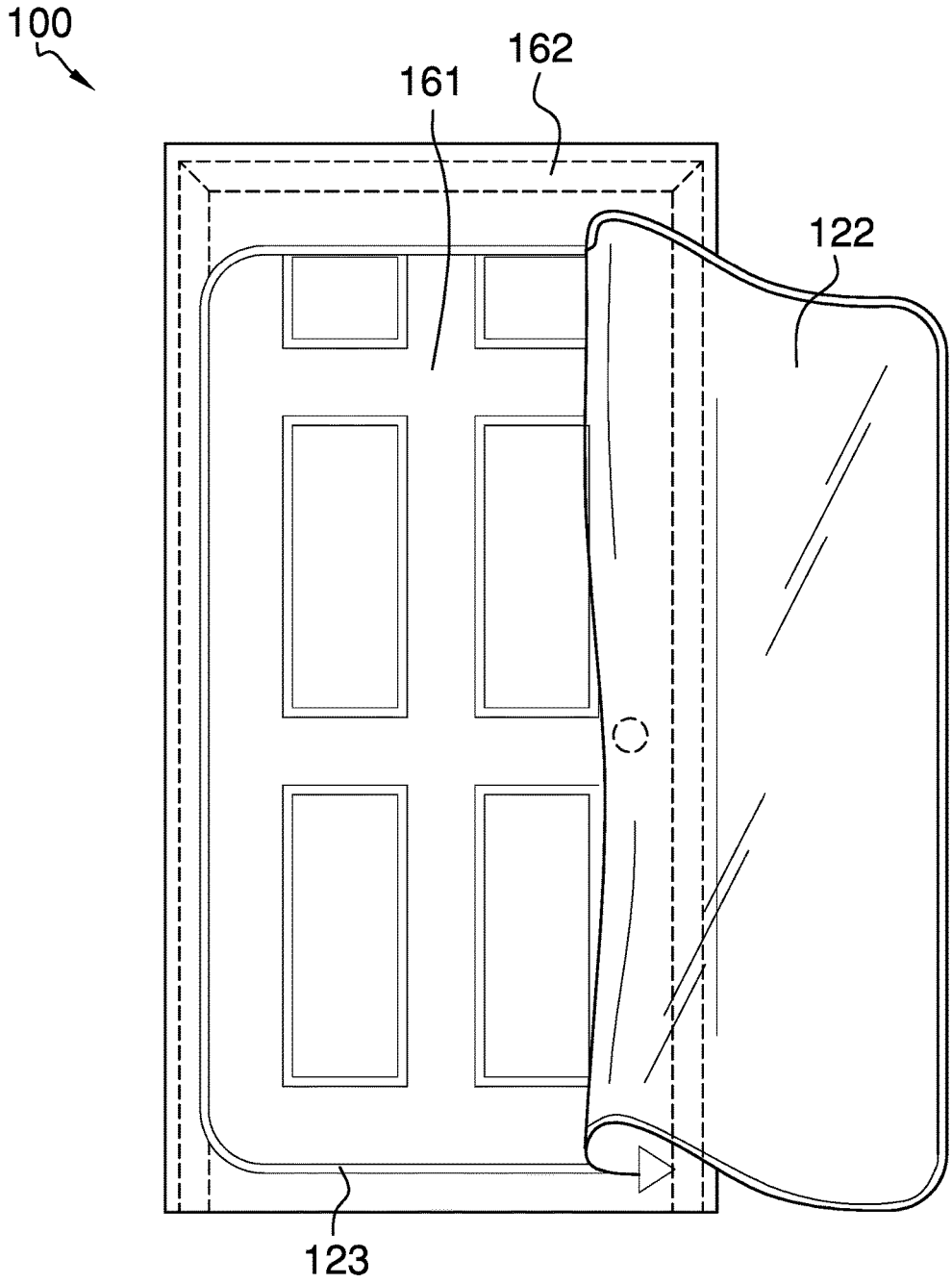
FIG. 5 is an in-use view of an embodiment of the disclosure.

Detailed reference will now be made to one or more potential embodiments of the disclosure, which are illustrated in FIGS. 1 through 5.

The door seal kit 100 (hereinafter invention) is configured for use with a door 161. The door 161 is further defined with a door jamb 162 and a plurality of door hinges 163. The invention 100 is a gas impermeable structure. The invention 100 forms a gas impermeable seal around the door 161. The gas impermeable seal prevents the exchange of gas from the atmosphere on the vestibule 171 side of the invention 100 to the side of the invention 100 that is distal from the vestibule 171. The invention 100 is used to contain gases, and their associated smells, within the room the door 161 accesses. The invention 100 comprises a jamb frame 101 and a sealing structure 102. The jamb frame 101 attaches the sealing structure 102 to the door jamb 162. The sealing structure 102 forms the gas impermeable barrier around the vestibule 171. The plurality of door hinges 163 attach the door 161 to the door jamb 162 such that the door 161 opens away from the invention 100 during normal use of the invention 100.

The door 161 is a structure that controls access into and out of a room. The door jamb 162 refers to a frame that creates an opening through a wall into a room. The door 161 attaches to the door jamb 162. The plurality of hinges 163 attaches the door 161 to the door jamb 162 such that the door 161 can rotate towards and away from the door jamb 162. The invention 100 is positioned relative to the plurality of hinges 163 such that the door 161 opens away from the vestibule 171. The vestibule 171 is an enclosed space created between the door 161 and the sealing structure 102.

The jamb frame 101 is a structure that attaches to the door jamb 162. The jamb frame 101 attaches the sealing structure 102 to the door jamb 162. The jamb frame 101 forms a gas impermeable seal around the door jamb 162. The jamb frame 101 comprises a hyoid 111 and a plurality of suspension beams 112.

The hyoid 111 is a semi-rigid structure. The hyoid 111 is a plate structure that is further defined with a first surface 181 and a second surface 182. The hyoid 111 attaches directly to the door jamb 162 of the door 161. The hyoid 111 attaches to the door jamb 162 such that a gas impermeable seal is formed between the door jamb 162 and the hyoid 111. The hyoid 111 comprises a first arm 131, a second arm 132, a crossbeam 133, and a first adhesive coating 151.

The first arm 131 is a rectangular plate structure. The first arm 131 attaches to the crossbeam 133 such that the first arm 131 projects perpendicularly away from the crossbeam 133 towards the supporting surface 191. The first arm 131 attaches to a first side of the door jamb 162. The second arm 132 is a rectangular plate structure. The second arm 132 attaches to the crossbeam 133 such that the second arm 132 projects perpendicularly away from the crossbeam 133 towards the supporting surface 191. The second arm 132 attaches to a second side of the door jamb 162. The second side is the side of the door jamb 162 that is distal from the first side.

The crossbeam 133 is a rectangular plate structure. The crossbeam 133 forms the superior edge of the hyoid 111. The crossbeam 133 is parallel to the supporting surface 191. The crossbeam 133 attaches to the superior edge of the door jamb 162.

Each of the plurality of suspension beams 112 is a beam that attaches to the second surface 182 of the hyoid 111. Each of the plurality of suspension beams 112 projects perpendicularly away from the hyoid 111. Each of the plurality of suspension beams 112 attaches to the hyoid 111 in the manner of a cantilever. The sealing structure 102 is draped from the plurality of suspension beams 112. The plurality of suspension beams 112 comprises a first suspension beam 141 and a second suspension beam 142.

The first suspension beam 141 attaches to the corner of the hyoid 111 formed by the first arm 131 and the crossbeam 133. The first suspension beam 141 projects perpendicularly away from the hyoid 111 in the manner of a cantilever. The first suspension beam 141 attaches to the second surface 182 of the hyoid 111. The second suspension beam 142 attaches to the corner of the hyoid 111 formed by the second arm 132 and the crossbeam 133. The second suspension beam 142 projects perpendicularly away from the hyoid 111 in the manner of a cantilever. The second suspension beam 142 attaches to the second surface 182 of the hyoid 111. The sealing structure 102 hangs from the first suspension beam 141 and the second suspension beam 142 such that the region of the sheeting 121 between the first suspension beam 141 and the second suspension beam 142 forms the superior surface of the vestibule 171.

The first adhesive coating 151 is an adhesive applied to the first surface 181. The first adhesive coating 151 attaches the jamb frame 101 to the door jamb 162 in a gas impermeable manner.

The sealing structure 102 is a flexible structure. The sealing structure 102 encloses the vestibule 171. The sealing structure 102 is a gas impermeable structure. The sealing structure 102 attaches to the jamb frame 101. The sealing structure 102 is further suspended from the jamb frame 101 such that the sealing structure 102 drapes in a manner that forms the vestibule 171. The sealing structure 102 is a gas impermeable barrier that contains gases on the vestibule 171 side of the sealing structure 102. The sealing structure 102 comprises a sheeting 121, an entry flap 122, a zipper 123, and a second adhesive coating 152.

The sheeting 121 is a commercially available gas impermeable sheeting 121. The sheeting 121 is formed in a rectangular shape. The sheeting 121 is formed from a polymer. The sheeting 121 is the gas impermeable barrier that forms and encloses the vestibule 171.

The entry flap 122 is a U shaped slice that is formed in the sheeting 121. The entry flap 122 is formed such that the U shaped slice does not cut the perimeter of the sheeting 121. The portion of the U shaped structure that remains attached to the sheeting 121 forms a hinge that allows the entry flap 122 to rotate towards and away from the plane formed by the sheeting 121.

The zipper 123 is a commercially available fastening device. The zipper 123 attaches the free edge of the entry flap 122 to the plane formed by the balance of the sheeting 121. The zipper 123 is described in greater detail elsewhere in this disclosure.

The second adhesive coating 152 is a structure that forms a seal between the sealing structure 102 and the supporting surface 191 associated with the inferior edges of the door jamb 162. The second adhesive coating 152 is an adhesive applied to a portion of the perimeter of the sealing structure 102. The second adhesive coating 152 attaches the sealing structure 102 to the supporting surface 191 in a gas impermeable manner. The second adhesive coating 152 is a removable adhesive.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Drape: As used in this disclosure, to drape means to arrange in a textile or sheeting such that the textile or sheeting hangs.

Fastener: As used in this disclosure, a fastener is a device that is used to join or affix two objects. Fasteners generally comprise a first element which is attached to the first object and a second element which is attached to the second object such that the first element and the second element join to affix the first object and the second object. Common fasteners include, but are not limited to, hooks, zippers, snaps, buttons, buckles, quick release buckles, or hook and loop fasteners.

Flap: As used in this disclosure, a flap is a piece of material that is hinged or otherwise attached to a surface using one side such that the piece of material hangs in such a way as to cover a hole in the surface.

Flexible: As used in this disclosure, flexible refers to an object or material that will deform when a force is applied to it but that will not necessarily return to its original shape when the deforming force is removed.

Hang: As used in this disclosure, to hang an object is to suspend an object above a surface from above such that the inferior end of the object does not form a significant portion of the load path of the object.

Hyoid: As used in this disclosure, a hyoid refers to a three-sided structure comprising a crossbeam, a first arm, and a second arm. In a hyoid, the first arm and the second arm project away from the crossbeam: 1) in the same direction; 2) at a roughly perpendicular angle to the crossbeam, and, 3) the span of the length of the first arm roughly equals the span of the length of the second arm. Hyoids generally have a U shaped appearance.

Inferior: As used in this disclosure, the term inferior refers to a directional reference that is parallel to and in the same direction as the force of gravity.

Perimeter: As used in this disclosure, a perimeter is one or more curved or straight lines that bounds an enclosed area on a plane or surface. The perimeter of a circle is commonly referred to as a circumference.

Polymer: As used in this disclosure, a polymer refers to a molecular chain that comprises multiple repeating units known as monomers. The repeating unit may be an atom or a molecular structure.

Removable Adhesive: As used in this disclosure, a removable adhesive is a commercially available adhesive that is designed with a lower tack, or stickiness, such that a first object is attached to a second object with a removable adhesive the first object can be readily removed in a manner that ideally, though not necessarily practically, leaves behind no adhesive residue on the second object. A repositionable adhesive is a subset of removable adhesives that are intended to allow the first object to be reattached to a third object or the second object in the initial or a different position. Within this disclosure, a removable adhesive is assumed to include repositionable adhesives.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Sheeting: As used in this disclosure, a sheeting is a material, such as a textile, a plastic, or a metal foil, in the form of a thin flexible layer or layers.

Superior: As used in this disclosure, the term superior refers to a directional reference that is parallel to and in the opposite direction of the force of gravity.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

Vestibule: As used in this disclosure, a vestibule refers to a chamber located in front of a door.

Zipper: As used in this disclosure, a zipper is a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An enclosure comprising:
wherein the enclosure comprises a jamb frame and a sealing structure;
wherein the sealing structure attaches to the jamb frame;
wherein the enclosure is configured for use with a door;
wherein the door is further defined with a door jamb and a plurality of door hinges;
wherein the enclosure is a gas impermeable structure;
wherein the enclosure forms a vestibule;
wherein the enclosure forms a gas impermeable seal around the door and the vestibule;
wherein the door opens away from the vestibule;
wherein the jamb frame is a structure that attaches to the door jamb;
wherein the jamb frame attaches the sealing structure to the door jamb;
wherein the jamb frame forms a gas impermeable seal around the door jamb;
wherein the jamb frame comprises a hyoid and a plurality of suspension beams;
wherein the plurality of suspension beams attach to the hyoid.

2. The enclosure according to claim 1
wherein the hyoid is further defined with a first surface and a second surface;
wherein the hyoid attaches to the door jamb;
wherein the hyoid forms a gas impermeable seal between the door jamb and the hyoid.

3. The enclosure according to claim 2
wherein the hyoid comprises a first arm, a second arm, a crossbeam, and a first adhesive coating;
wherein the first arm and the second arm attach to the crossbeam;
wherein the first adhesive coating is applied to the first surfaces of the crossbeam, the first arm, and the second arm.

4. The enclosure according to claim 3
wherein the first arm attaches to the crossbeam such that the first arm projects perpendicularly away from the crossbeam;
wherein the second arm attaches to the crossbeam such that the second arm projects perpendicularly away from the crossbeam.

5. The enclosure according to claim 4
wherein the first arm attaches to a first side of the door jamb;
wherein the second arm attaches to a second side of the door jamb;
wherein the second side is the side of the door jamb that is distal from the first side.

6. The enclosure according to claim 5
wherein the crossbeam attaches to the superior edge of the door jamb.

7. The enclosure according to claim 6
wherein the crossbeam is parallel to the supporting surface.

8. The enclosure according to claim 7
wherein each of the plurality of suspension beams is a beam;

wherein each of the plurality of suspension beams attaches to the second surface of the hyoid;

wherein each of the plurality of suspension beams attaches to the hyoid in the manner of a cantilever.

9. The enclosure according to claim 8 wherein each of the plurality of suspension beams projects perpendicularly away from the hyoid.

10. The enclosure according to claim 9 wherein the sealing structure is draped from the plurality of suspension beams.

11. The enclosure according to claim 10 wherein the plurality of suspension beams comprises a first suspension beam and a second suspension beam;

wherein the first suspension beam attaches to the corner of the hyoid formed by the first arm and the crossbeam;

wherein the second suspension beam attaches to the corner of the hyoid formed by the second arm and the crossbeam.

12. The enclosure according to claim 11 wherein the first adhesive coating is an adhesive applied to the first surface;

wherein the first adhesive coating attaches the jamb frame to the door jamb in a gas impermeable manner.

13. The enclosure according to claim 12 wherein the sealing structure is a flexible structure;

wherein the sealing structure is a gas impermeable structure;

wherein the sealing structure hangs from the first suspension beam and the second suspension beam such that the region of the sheeting between the first suspension beam and the second suspension beam forms the superior surface of the vestibule.

14. The enclosure according to claim 13 wherein the sealing structure comprises a sheeting, an entry flap, a zipper, and a second adhesive coating;

wherein the entry flap is formed in the sheeting;

wherein the zipper attaches to the sheeting;

wherein the second adhesive coating attaches the sheeting to a supporting surface.

15. The enclosure according to claim 14 wherein the sheeting is a gas impermeable sheeting;

wherein the sheeting is formed in a rectangular shape;

wherein the sheeting is formed from a polymer;

wherein the entry flap is a U shaped slice that is formed in the sheeting;

wherein the entry flap is formed such that the U shaped slice does not cut the perimeter of the sheeting;

wherein the zipper is a fastening device.

16. The enclosure according to claim 15 wherein the second adhesive coating forms a seal between the sealing structure and the supporting surface;

wherein the second adhesive coating is a removable adhesive.

* * * * *